United States Patent [19]

Iwasaki et al.

[11] Patent Number: 4,728,856

[45] Date of Patent: Mar. 1, 1988

[54] CATHODE RAY TUBE

[75] Inventors: Yasuo Iwasaki; Koji Yajima, both of Kyoto, Japan

[73] Assignee: Mitsubishi Denki Kabushiki Kaisha, Tokyo, Japan

[21] Appl. No.: 607,729

[22] Filed: May 9, 1984

Related U.S. Application Data

[63] Continuation of Ser. No. 338,993, Jan. 12, 1982, abandoned.

[30] Foreign Application Priority Data

Feb. 13, 1981 [JP] Japan ..... 56-21151
Feb. 13, 1981 [JP] Japan ..... 56-21170

[51] Int. Cl.[4] ..... H01J 29/20; H01J 29/86
[52] U.S. Cl. ..... 313/467; 313/480
[58] Field of Search ..... 313/467, 408; 252/301.6 R

[56] References Cited

U.S. PATENT DOCUMENTS 3,143,683 8/1964 Duncan et al. ..... 313/480
4,038,205 7/1977 Minnier et al. ..... 313/467 X
4,309,481 1/1982 Wakatsuki et al. ..... 313/466 X

FOREIGN PATENT DOCUMENTS 2804155 3/1978 Fed. Rep. of Germany ..... 313/467
3010386 9/1980 Fed. Rep. of Germany ..... 313/480
2807085 3/1986 Fed. Rep. of Germany .

*Primary Examiner*—David K. Moore
*Assistant Examiner*—Sandra L. O'Shea
*Attorney, Agent, or Firm*—Oblon, Fisher, Spivak, McClelland & Maier

[57] ABSTRACT

A cathode ray tube comprises a face plate glass containing neodymium oxide ($Nd_2O_3$); and a phosphor screen of plural color phosphors formed on an inner surface of said face plate glass wherein a phosphor of zinc sulfide activated with copper and aluminum (ZnS:Cu, Al) or a phosphor of zinc sulfide activated with copper, gold and aluminum (ZnS:Cu, Au, Al) is used as a green phosphor of said phosphor screen.

6 Claims, 19 Drawing Figures

CATHODE RAY TUBE

This application is a continuation of application Ser. No. 338,993, filed Jan. 12, 1982 now abandoned.

1. Field of the Invention

The present invention relates to a color cathode ray tube having a phosphor screen.

2. Description of the Prior Art

It has been proposed to reduce a transmittance of a face plate glass on a phosphor screen as an effective manner for improving image contrast of a phosphor screen of a cathode ray tube.

Referring to FIG. 1, the principle will be illustrated in detail.

FIG. 1 is a sectional model of the phosphor screen of the color cathode ray tube wherein the reference numeral (1) designates a face plate glass on an inner surface of which three color phosphors (2) of red (R), green (G) and blue (B) are formed.

The following equations are give:

$$E_1 = E_o \cdot R_p \cdot T_f^2 \quad \text{(I)}$$

$$F_1 = F_o \cdot T_f \quad \text{(II)}$$

wherein $E_o$ represents an intensity of exterior incident light to the face plate glass (1) of the color cathode ray tube having the structure; $E_1$ represents an intensity of reflective light reflected on the phosphor screen to emit out of the face plate glass (1); $T_f$ represents a light transmittance of the face plate glass (1); $R_p$ represents reflectance of the red (R) green (G) blue (B) three color phosphors (2); $F_o$ represents an intensity of light emission of three color phosphors and $F_1$ represents an output of light emitted from the phosphor screen and passed through the face plate glass (1).

A contrast C is defined by the equation:

$$C = \frac{E_1 + F_1}{E_1} \quad \text{(III)}$$

Thus, the following equation is given by substituting (I) and (II) in (III):

$$C = 1 + \frac{F_o}{E_o \cdot R_p \cdot T_f} \quad \text{(IV)}$$

In precise calculation, it is necessary to apply factors caused by effects of reflection of exterior light on the surface of the face plate glass, multiple reflections in the face plate glass (1) and halation caused by scattered electrons. Thus, the effects are neglected because the effects are negligible.

In order to improve the contrast of images of the cathode ray tube, the light transmittance ($T_f$) of the face plate glass (1) must be reduced as clearly considered by the equation (IV).

The glass used as the face plate glass (1) of the cathode ray tube has been classified into a clear glass having a transmittance of 75% or more; a grey glass having a transmittance of 60–75% and a tint glass having a transmittance of 60% or less.

FIG. 2 show typical spectral transmittance curves of (a) a clear glass, (b) a grey glass and (c) a tint glass and also emission spectra of the three color phosphors of red (R), green (G), blue (B).

On the other hand, as it is clearly found from FIG. 2 and the equation (II), the output of light emitted from the phosphor screen as brightness of the phosphor screen decreases depending upon a decrease of the transmittance ($T_f$) of the face plate glass (1). This is opposite to the contrast. In view of the transmittance ($T_f$) of the face plate glass (1), both of the contrast characteristic of images and the brightness characteristic are not easily improved. The kind of the face plate glass (1) has been selected depending upon the weight of the contrast or the brightness characterstic.

It has been defined to give selective photo-absorption for the face plate glass (1) in the region of small light emission energy as the wavelength region in roots of the emission spectra of the three color phosphors on the phosphor screen instead of the face plate glass having flat transmittance in visible wavelength region as shown in FIG. 2 in order to overcome the difficulty for improving both the brightness and the contrast and to improve both the brightness characteristic and the contrast characteristic.

FIG. 3 shows a spectral transmittance curve of the face plate glass (1) proposed for the aforementioned purposes.

The face plate glass is formed by incorporating neodymium oxide ($Nd_2O_3$) (at 1.0 wt. %) in a glass formulation similar to those of the conventional clear glass (hereinafter referring to as Nd-containing glass). The Nd-containing glass has main sharp absorption peak in 560–615 nm and sub-absorption peaks in 490–540 nm, which is resulted by the specific characteristics of $Nd_2O_3$. The absorption peaks are quite sharp and accordingly, even though light transmittances in the other wavelength except the absorption peaks are remarkably high as those of the conventional clear glass an average light transmittance in the all visible wavelength region is similar to those of the grey glass thereby contributing to the improvement of the contrast.

FIG. 4 shows spectral transmittance curve (d) of the Nd-containing glass and emission spectra of the three color phosphors of red (R), green (G), blue (B) of the color cathode ray tube.

When the Nd-containing glass is used for the face plate glass, the brightness characteristic of the phosphor screen and the contrast characteristic are remarkably improved. However, the body color of the phosphor screen is quite different from those of the conventional color cathode ray tubes to cause uneasy feeling for a spectator in appearance.

Referring to FIG. 5, the body color of the phosphor screen will be illustrated in detail. In FIG. 5, the points A, B, C are typical chromaticity points of white exterior light plotted on a CIE chromaticity diagram in the case of watching a TV set at home. The A point is the chromaticity point of the A standard light source which is similar to the chromaticity point of light of an incandescent lamp used at home. The B point is one example of chromaticity points of light of white flurescent lamp used at home. The C point is a chromaticity point of the C standard light source as an average daylight.

When the spectral reflectance of the phosphors (2) of the phosphor screen is substantially flat in the visible wavelength region and the spectral transmittance of the face plate glass (1) is substnatially flat in the visible wavelength region as that of the clear glass, the chromaticity point of the reflected exterior light reflected from the phosphor screen, that is the body color of the phosphor screen is similar to the chromaticity point of the exterior lighter.

On the other hand, when the Nd-containing glass is used for the face plate glass on the phosphor screen, the spectral transmittance of the face plate glass is not flat in the visible wavelength region but has complicated cuves. Thus, the chromaticity point of the reflected exterior light reflected from the phosphor screen, that is, the body color of the phosphor screen is different from the chromaticity point of the white exterior light.

The case of the illuminant A (A point shown in FIG. 5) will be illustrated. In the case of the exterior light from the illuminant A, the exterior light incident to the phosphor screen is reflected by the phosphors (2) in substantially flat form in the visible wavelength, however, the component of wavelength of the reflected exterior light is different from that of the incident exterior light because of the sharp absorption at 580 nm and sub-absorption in the sub-absorption band at 530 nm of the Nd-containing glass. The effect is shown in the CIE chromaticity diagram to find the following fact. The main absorption band at 580 nm results in a reduction of the component of the wavelength at the band of the exterior light whereby the chromaticity point is affected to depart from the single color chromaticity point (Q) at 580 nm on the line ($\beta$) connecting the single color chromaticity point (Q) at 580 nm and the chromaticity point (A) of the A light source. (This is shown by the vector $a_2$.)

The sub-absorption band at 530 nm results in a reduction of the component of the wavelength at the band of the exterior light whereby the chromaticity point of the reflected exterior light is affected to depart from the single color chromaticity point (R) at 530 nm on the line ($\alpha$) connecting the single color chromaticity point (R) at 530 nm and the chromaticity point (A) of the illuminant A. (This is shown by the vector $a_1$.) Therefore, the chromaticity point of the reflected exterior light, that is, the body color of the phosphor screen is shifted to the vector $a_3$ as a combination of the vectors $a_1$ and $a_2$. The absorption in the main absorption band is remarkably greater than that of the subabsorption band. Thus, the absolute value of the vector $a_2$ is remarkably greater than the absolute value of the vector $a_1$.

In the cases of the white fluorescent lamp (B point) and the illuminant C (C point), the chromaticity point of the reflected exterior light, that is, the body color of the phosphor screen is respectively shifted in the direction of the vector $b_3$ or the vector $c_3$. In these cases, the absolute value of the vector $b_2$ or the vector $c_2$ is respectively greater than that of the vector $b_1$ or the vector $c_1$ because of the great difference of the absorptions in the main absorption band and the sub-absorption band. As described, when the Nd-containing glass is used as a face plate glass, the body color of the phosphor screen is different from the chromaticity of the white exterior light to be unstable. This is not preferable in view of the apperance of the phosphor screen.

SUMMARY OF THE INVENTION

It is an object of the present invention to overcome a disadvantage of unstable body color of a phosphor screen which causes by using a Nd-containing glass as a face plate glass of a color cathode ray tube.

It is another object of the present invention to provide a color cathode ray tube having stable body color of a phosphor screen in the use of a face plate glass made of a Nd-containing glass.

The foregoing and other objects of the present invention have been attained by providing a cathode ray tube which comprises a face plate glass containing neodymium oxide ($Nd_2O_3$); and a phosphor screen of plural color phosphors formed on an inner surface of said face plate glass wherein a phosphor of zinc sulfide activated with copper and aluminum (ZnS:Cu, Al) is used as a green phosphor of said phospor screen.

DETAILED DESCRIPTION OF THE PREFERRED EMBODIMENTS

Figure 1:
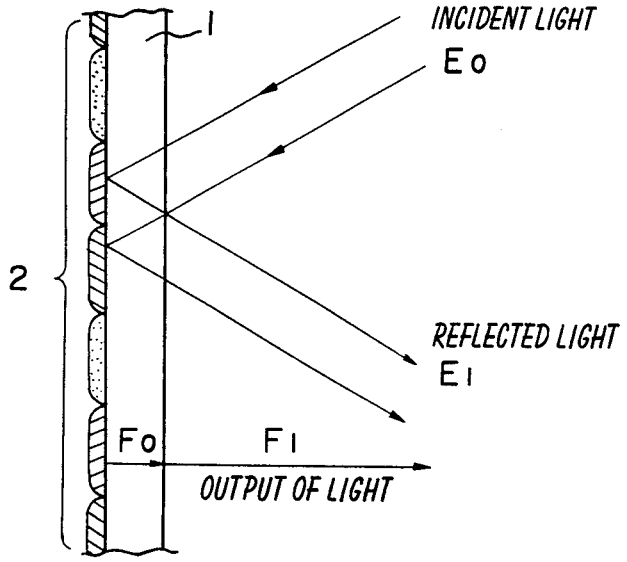
FIG. 1 is a sectional model of a phosphor screen of a cathode ray tube.
Figure 2:
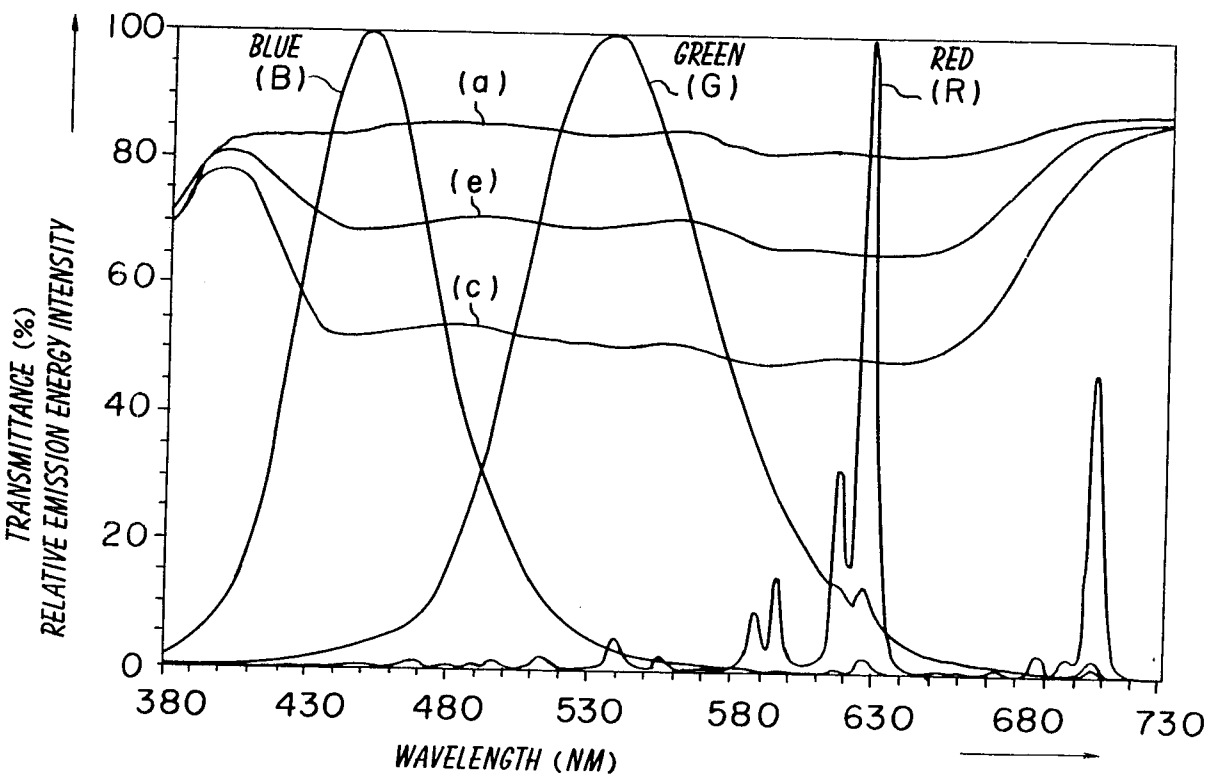
FIG. 2 shows typical spectral transmittance curves of various glasses.
Figure 3:
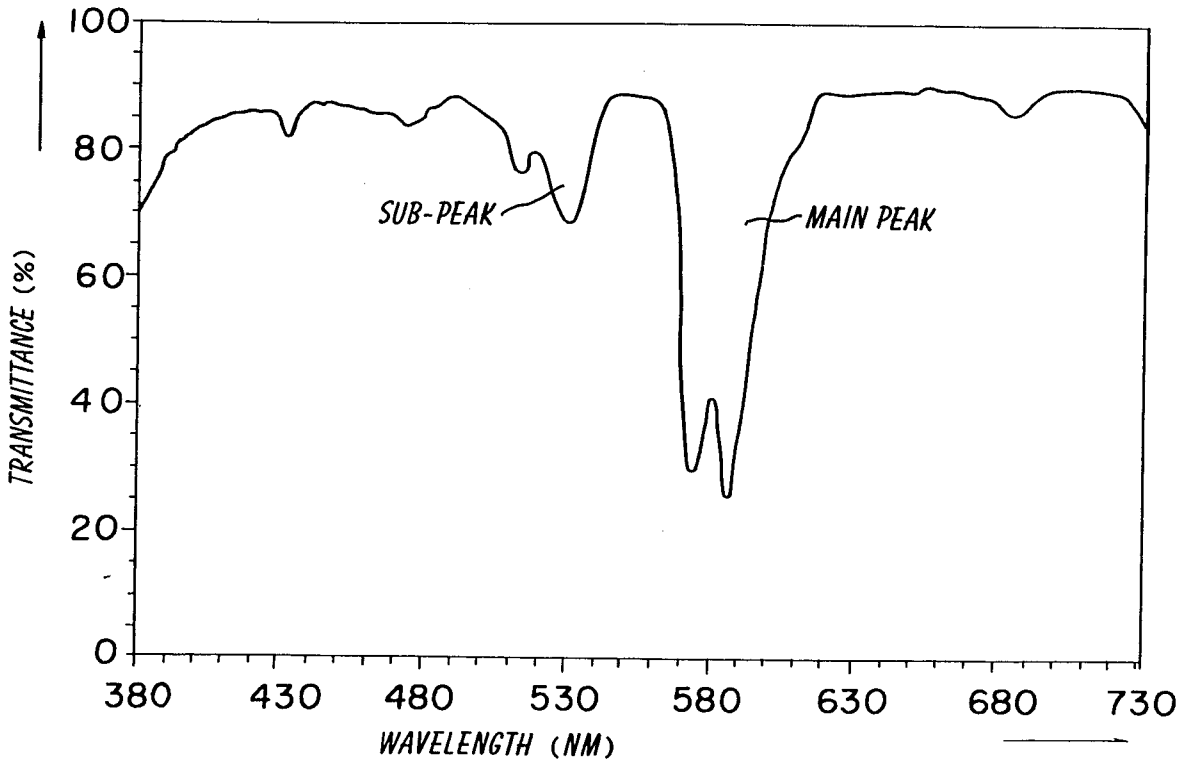
FIG. 3 shows a spectral transmittance curve of the Nd-containing glass.
Figure 4:
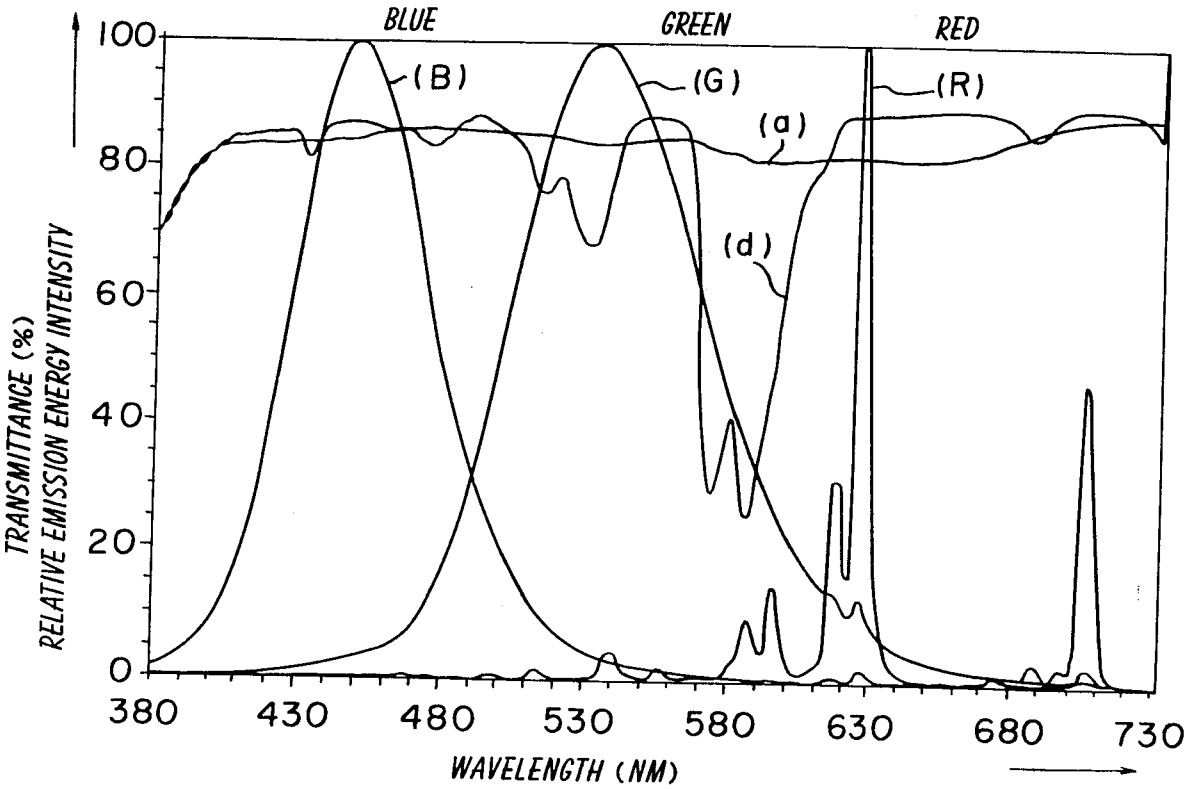
FIG. 4 shows spectral transmittance curves of the Nd-containing glass and a clear glass.
Figure 5:
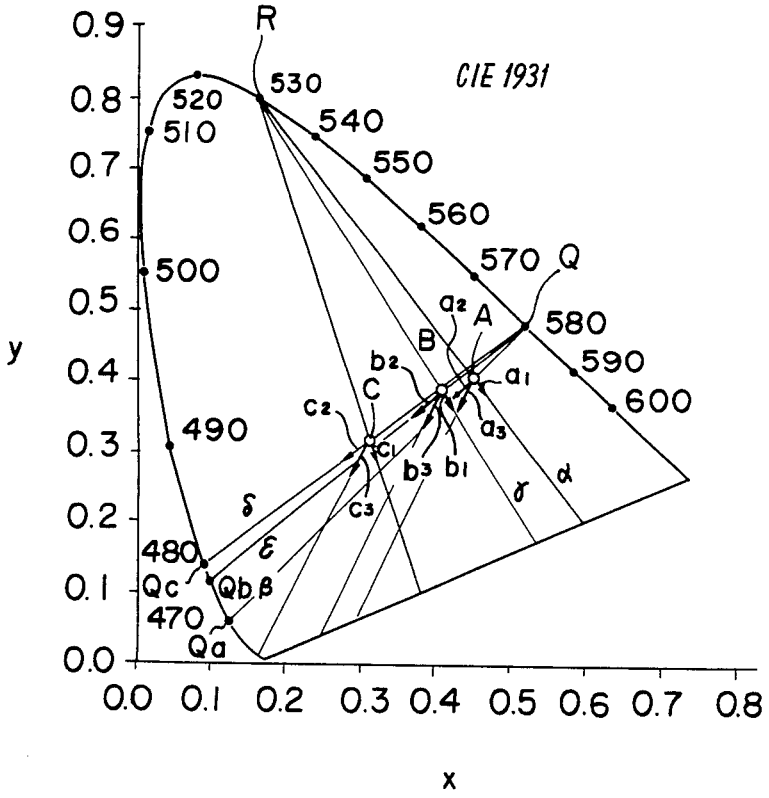
FIG. 5 is a CIE chromaticity diagram plotting chromaticity points of white exterior light on a white diagram.

Referring to FIGS. 5 to 13, one embodiment of the present invention will be illustrated. Firstly, referring to FIG. 5, the principle of the present invention will be illustrated.

When the Nd-containing glass is used for the face plate glass on the phosphor screen, the body color of the phosphor screen is highly changed by the vector ($a_2$, $b_2$, $c_2$) on the chromaticity diagrams which is caused by the main absorption band at 580 nm and the vector ($a_1$, $b_1$, $c_1$) which is caused by the sub-absorption band at 530 nm. Thus, the vector ($a_1$, $b_1$, $c_1$) is remarkably less than the vector ($a_2$, $b_2$, $c_2$). In the present invention, the stability of the body color of the phosphor screen is considered in view of the vector ($a_2$, $b_2$, $c_2$). In order to eliminate the effect of the vector ($a_2$, $b_2$, $c_2$), it is preferable to result in a reverse vector ($-a_2$, $-b_2$, $-c_2$).

The method of formation of the reverse vector in the case of the chromaticity point of the illuminant A will be illustrated. The cross point (Qa point) of the line $\beta$ connecting the single color chromaticity point Q of the main absorption band at 580 nm and the chromaticity (A) of the illuminant A to the contour line is a single color chromaticity point at about 470 nm. When the light component at about 470 nm among the light components of the reflected exterior light is reduced at a desired degree by a suitable manner, the chromaticity point is shifted to depart from the single color chromaticity point Qa on the line $\beta$ connecting the single color chromaticity point Qa at about 470 nm and the chromaticity point (A) of the illuminant A whereby the vector $-a_2$ is resulted. In the cases of the other kinds of the white exterior lights, the cross point Qb, Qc of the line $\epsilon\delta$ and the contour line are at about 480 nm. The light component at about 480 nm among the light components of the reflected exterior light is reduced at a desired degree whereby the vectors $-b_2$ and $-c_2$ are formed.

When the Nd-containing glass is used for the face plate glass on the phosphor screen, the change of the body color on the phosphor screen can be substantially eliminated by reducing the light components at 470–480 nm of the reflected exterior light.

In order to reduce the light components at 470–480 nm among the light components of the reflected exterior light, it is enough to reduce the spectral reflectance of the three color phosphors (2) at the wavelength band of 470–480 nm.

The inventors have studied stability of the body color of the phosphor screen in the combinations of various phosphors having desired emission spectrum for the three color phosphors of the phosphor screen of the color cathode ray tube and the face plate glass made of the Nd-containing glass. As a result, it has been to provide a phosphor screen having stable body color by using a phosphor zinc sulfide activated with copper and aluminum (ZnS:Cu, Al) as the green (G) phosphor among the three color phosphors (2).

Referring to FIGS. 6 to 13, the embodiment of the invention will be further illustrated.

Figure 6:
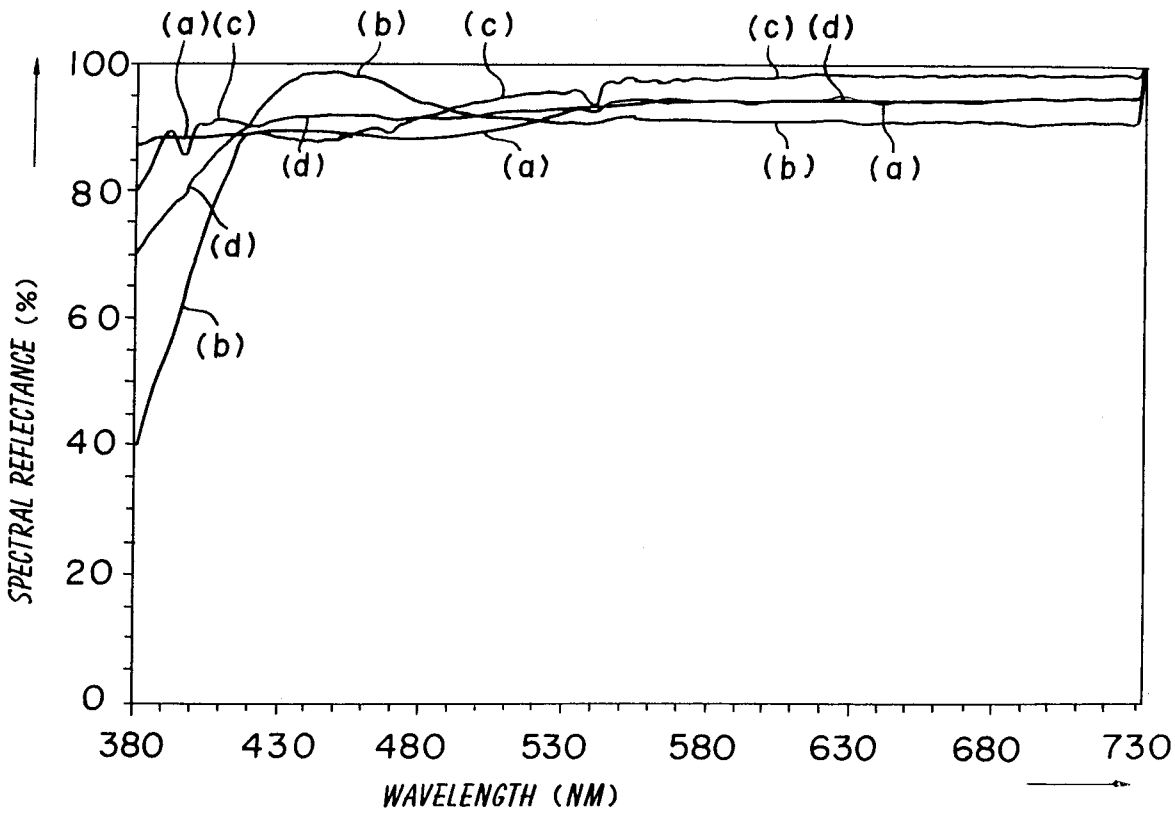
FIGS. 6 to 8 respectively show spectral reflection characteristics of three color phosphors made of various combinations of phosphors.

FIG. 6 shows spectral reflection characteristics given by an undesired combination of phosphors for the three color phosphors (2). More particularly, FIG. 6 shows spectral reflection characteristics of a phosphor of gadolinium oxysulfide activated with Tb ($Gd_2O_2S$:Tb) as a green (G) phosphor; a phosphor of zinc sulfide activated wiht Ag (ZnS:Ag) as a blue (B) phosphor and a phosphor of yttrium oxysulfide activated with Eu ($Y_2O_2S$:Eu) as the three color phosphors (2) and a spectral reflection characteristic of the three color phosphors (2) as a combination of said phosphors. In FIG. 6, the reference (a), (b), (c) and (d) respectively represent spectral reflectance curves of the $Gd_2O_2S$:Tb phosphor, the ZnS:Ag phosphor, the $Y_2O_2S$:Eu phosphor and the three color phosphors (2) thereof.

The spectral reflectance curve (d) of the three color phosphors (2) is not substantially reduced at 470–480 nm and accordingly, it is not desired in view of the body color of the phosphor screen.

Figure 7:
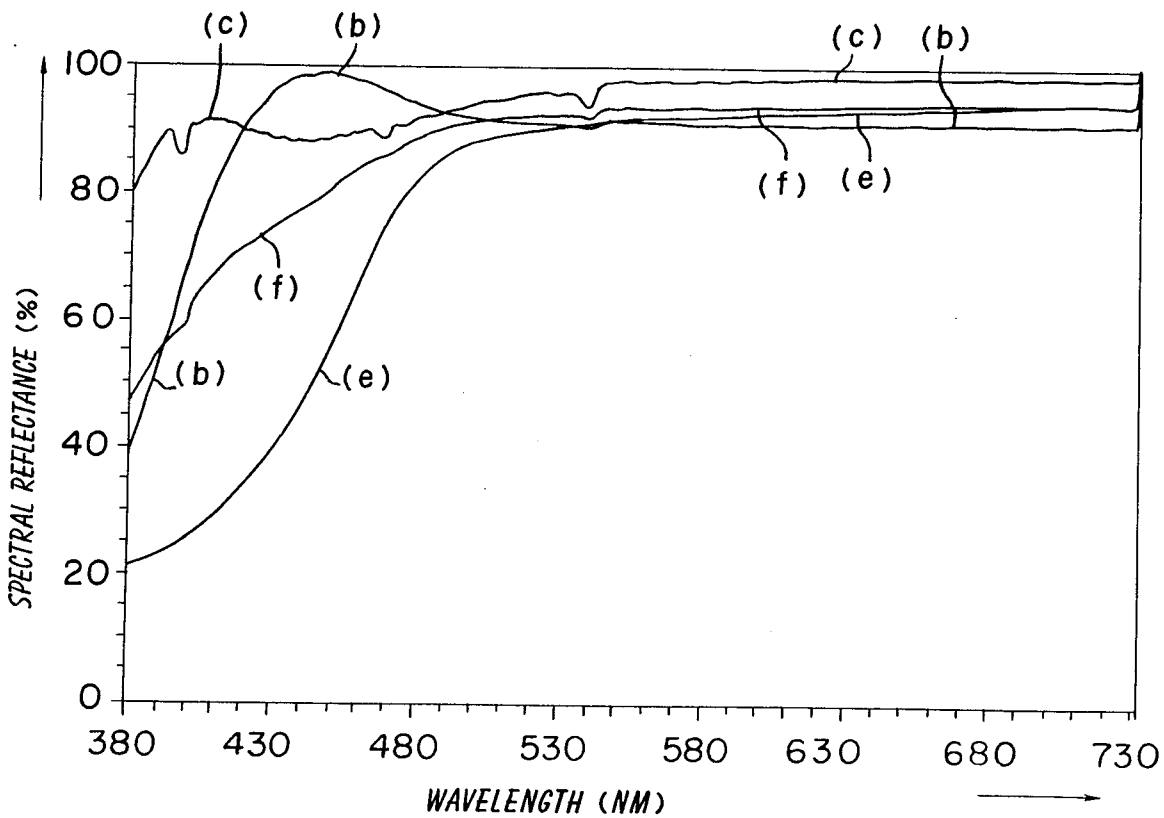

FIG. 7 shows spectral reflection characteristic of a desired combination of the three color phosphors (2).

The blue (B) phosphor and the red (R) phosphor are the same as the phosphors in FIG. 6 as the ZnS:Ag phosphor and the $Y_2O_2S$:Eu phosphor. Thus, the green (G) phosphor is the ZnS:Cu, Al phosphor which has a spectral reflectance curve (e). Thus, the three color phosphor (2) has the spectral reflectance curve (f) which has the reduction at 470–480 nm. Therefore, the desired body color of the phosphor screen is given by the combination of the three color phosphors and the face plate glass made of a Nd-containing glass. This is resulted by great reduction of the spectral reflectance curve (e) of the ZnS:Cu, Al phosphor used as the green (G) phosphor of the three color phosphors (2) in the shorter wavelength side of the visible wavelength region. The reduction of the spectral reflectance curve in the shorter wavelength side of the visible wavelength region is highly affected by a content of Cu as the activator for the phosphor. In the case of the ZnS:Cu, Al phosphor having the spectral reflectance curve (e), 1 g. of zinc sulfide (ZnS) is activated with about $1\times10^{-4}$ g. of Cu as the activator. The reduction of the spectral reflectance curve in the shorter wavelength side of the visible wavelength region increases depending upon an increase of the content of Cu as the activator.

Figure 8:
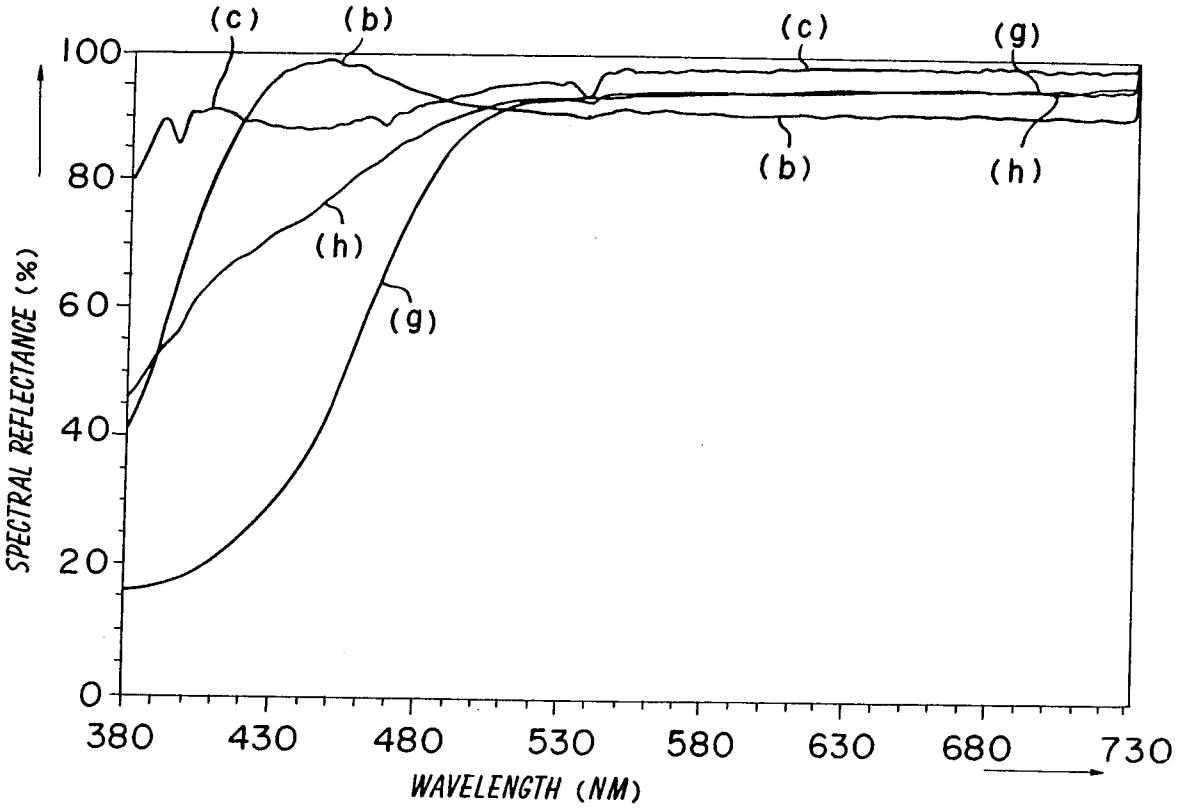

FIG. 8 shows the spectral reflectance curves in the case of the increase of the content of Cu as the activator in the ZnS:Cu, Al phosphor used as the green (G) phosphor. The blue (B) phosphor and the red (R) phosphor are respectively the ZnS:Ag phosphor and the $Y_2O_2S$:Eu phosphor shown in FIGS. 6 and 7. In this case, 1 g. of zinc sulfide is activated with about $5\times10^{-4}$ g. of Cu as the activator. The spectral reflectance curve of the ZnS:Cu, Al phosphor is the curve (g) in which the reduction in the shorter wavelength side of the visible wavelength region is greater than that of the curve (e) in FIG. 7. As result, the spectral reflectance curve of the three color phosphors (2) is the curve (h) in which the reduction in the shorter wavelength of the visible wavelength region is greater than that of the curve (f) in FIG. 7.

Figure 9:
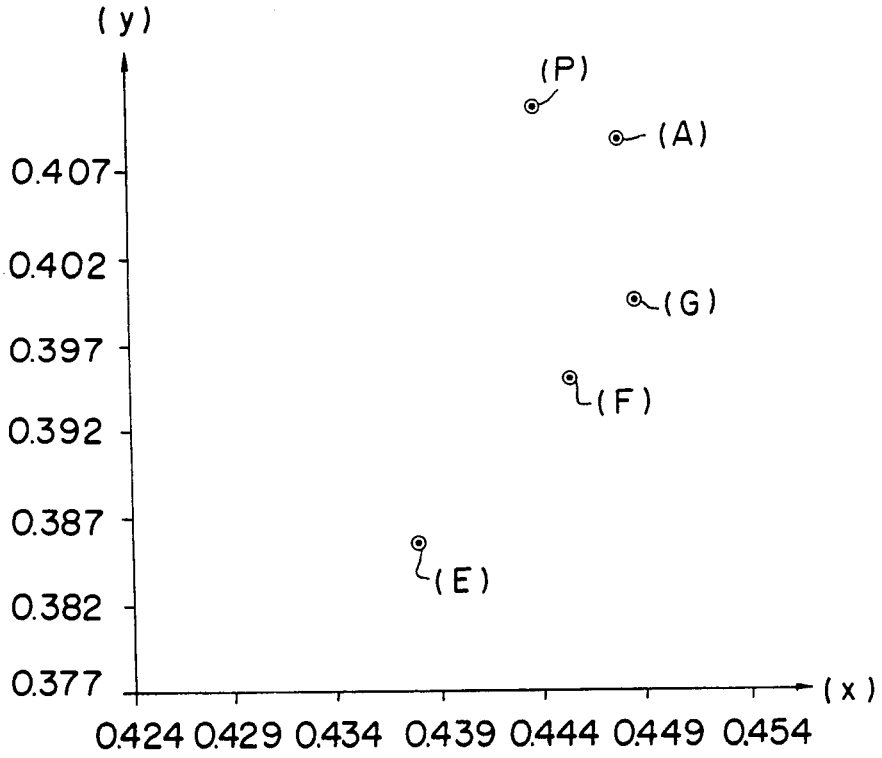
FIG. 9 is a CIE chromaticity diagram plotting chromaticity points of body colors of various phosphor screens.

FIG. 9 is a CIE chromaticity diagram plotting the body color of the phosphor screen by the light of the illuminant A as the white exterior light in the case of the formation of the three color phosphors (2) in said combination on the face plate glass made of a Nd-containing glass. In FIG. 9, the reference (A) designates a chromaticity point of the A light source; and the reference (P) designates a chromaticity point of the reflected exterior light from the phosphor screen, as the body color of the phosphor screen in the case of the formation of the three color phosphors (2) having substantially flat spectral reflectance as shown in FIG. 6(*d*) as the combination of the $Gd_2O_2S$:Tb green (G) phosphor, the ZnS:Ag blue (B) phosphor and the $Y_2O_2S$:Eu red (R) phosphor on an inner surface of the face plate glass made of the clear glass. The position (P) is slightly different from the position (A) because the spectral transmittance of the clear glass is not completely flat but has slightly difference and the spectral reflectance of the three color phosphors (2) has slightly difference. The reference (E) designates a chromaticity point of the reflected exterior light from the phosphor screen, as the body color of the phosphor screen in the case of the formation of the three color phosphors (2) shown in FIG. 6 as the undesired combination of the $Gd_2O_2S$:Tb green (G) phosphor, the ZnS:Ag blue (B) phosphor and the $Y_2O_2S$:Eu red (R) phosphor on an inner surface of the face plate glass made of the Nd-containing glass. In this case, the body color of the phosphor screen is remarkably shifted from the chromaticity point (A) of the illuminant A as the white exterior light whereby unstable chromaticity is given and the appearance of the phosphor screen is not preferable. The reference (F) designates a chromaticity point of the reflected exterior light from the phosphor screen, as the body color of the phosphor screen in the case of the formation of the three color phosphor shown in FIG. 7 as the desired combination of the ZnS:Cu, Al green (G) phosphor, the ZnS:Ag blue (B) phosphor and the $Y_2O_2S$:Eu red (R) phosphor on an inner surface of the face plate glass made of the Nd-containing glass. As described, the light component at 470–480 nm in the reflected exterior light is reduced and the shift from the chromaticity point (A) of the illuminant A is remarkably smaller than that of the (E) point.

The reference (G) designate the chromaticity point as the body color of the phosphor screen of the three color phosphors (2) containing the ZnS:Cu, Al phosphor having larger content of Cu as the activator. The shift from the chromaticity point (A) of the illuminant A is less than that of the (F) point.

In view of the contribution for the stability of the body color of the phosphor screen used with the face plate glass made of the Nd-containing glass. The content of Cu as the activator in the ZnS:Cu, Al phosphor is preferably $5\times10^{-5}$ g. or more to 1 g. of zinc sulfide as the main component. The stability of the body color of the phosphor screen is further improved by the content of Cu of $3\times10^{-4}$ g. or more to 1 g. of zinc sulfide.

Figure 10:
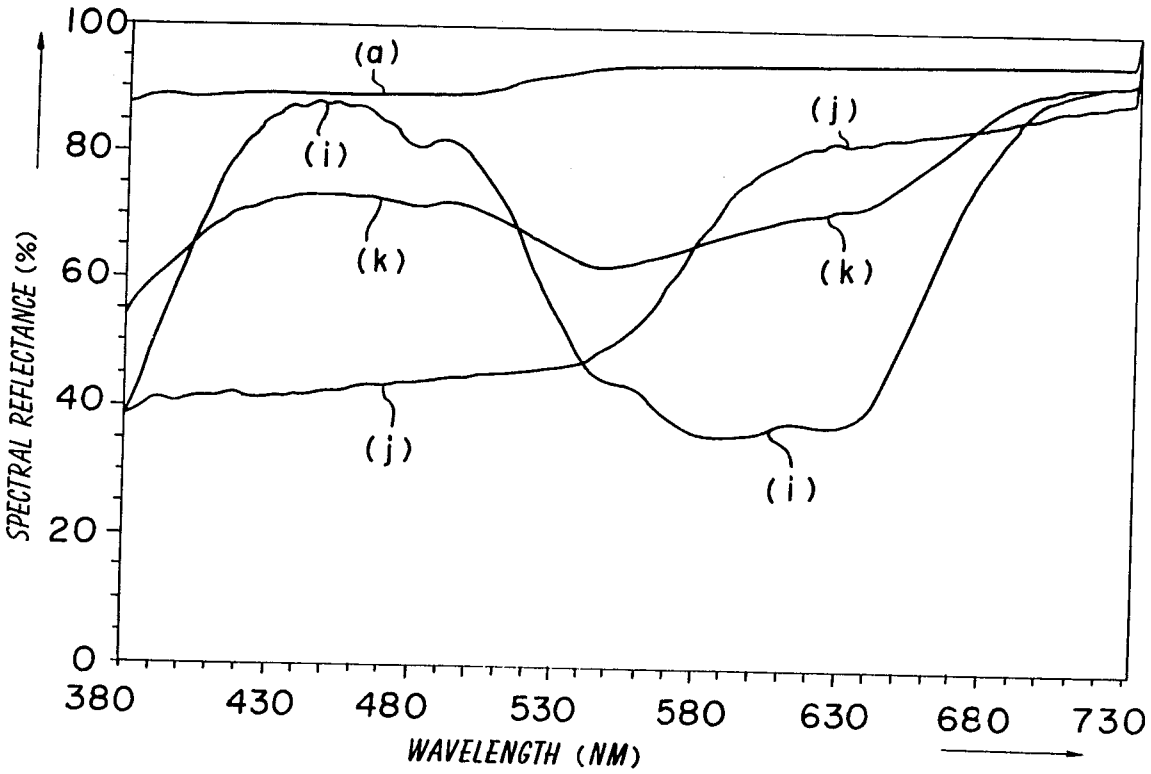
FIGS. 10 to 12 respectively show spectral reflection characteristics of three color phosphors made of various combinations of phosphors.
Figure 11:
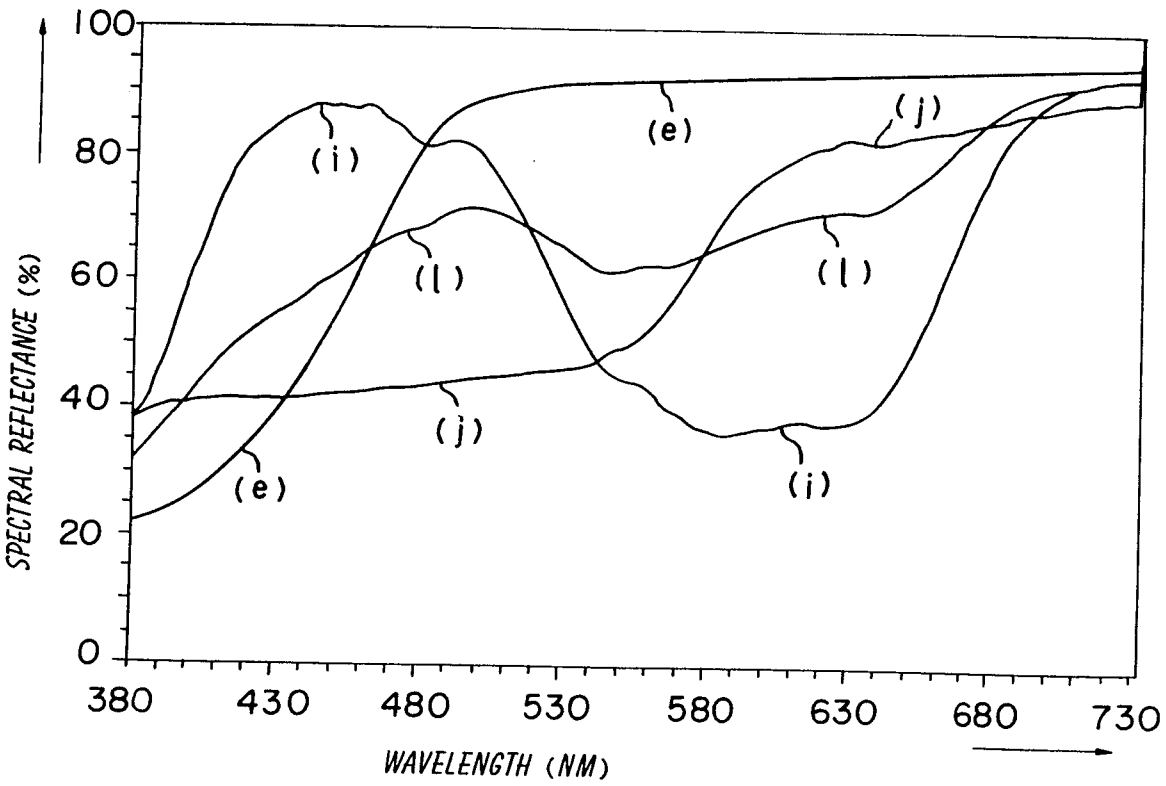
Figure 12:
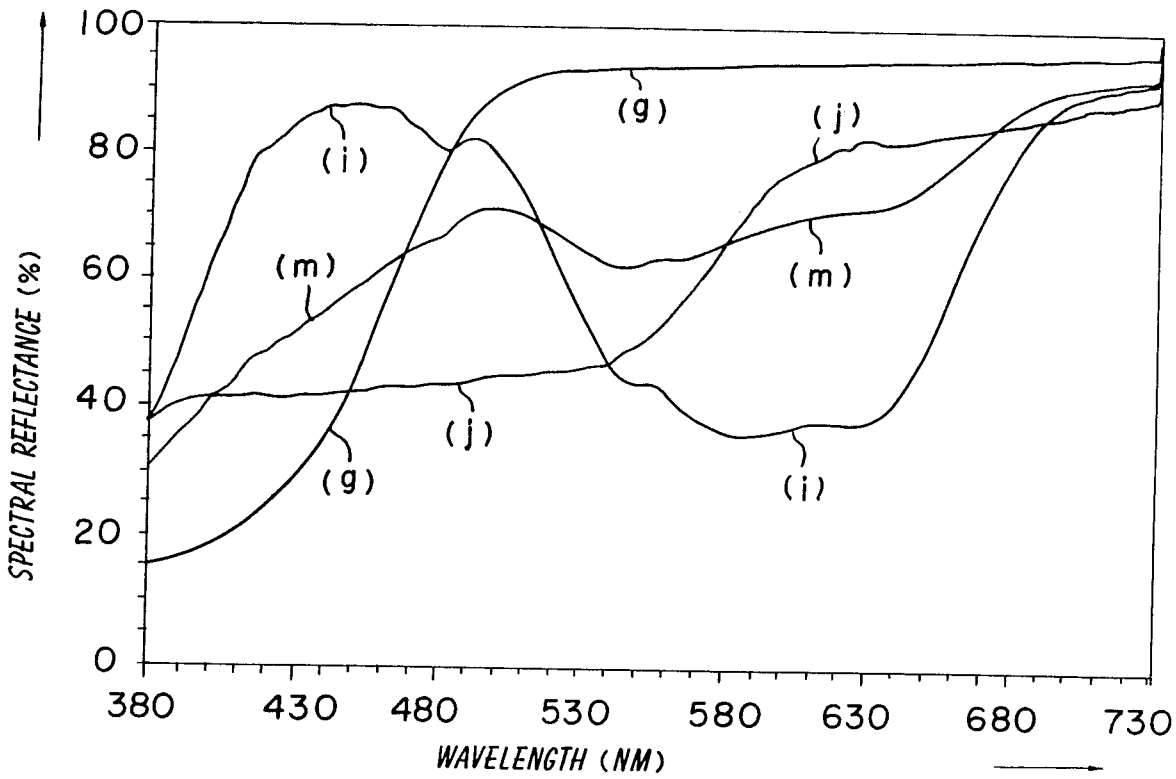
Figure 13:
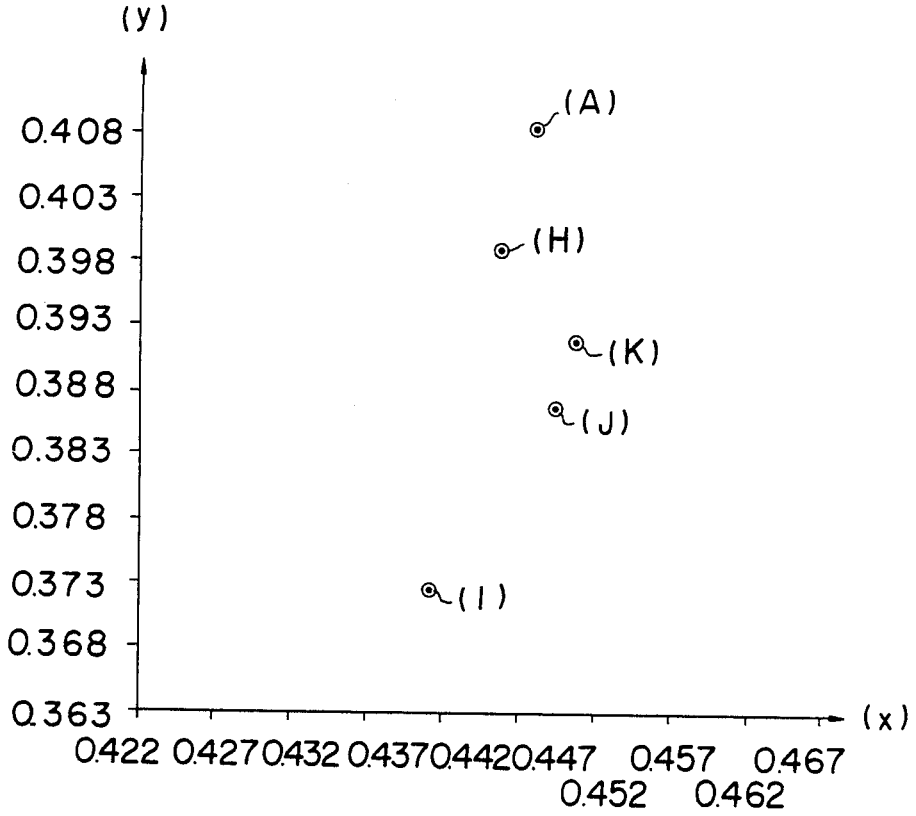
FIG. 13 is a CIE chromaticity diagram plotting chromaticity points of body colors of various phosphor screens.

FIGS. 10 to 12 show the spectral reflectance curves of the ZnS:Ag blue phosphor with a blue colorant, as a blue (B) phosphor the $Y_2O_2S$:Eu phosphor with a red colorant as a red (R) phosphor which are recently used to improve the contrast of the phosphor screen and various green (G) phosphor and the three color phosphors as the combinations (FIGS. 10 to 12) and a CIE chromaticity diagram FIG. 13 plotting body colors of the phosphor screens of said three color phosphors formed on the inner surface of the face plate glass made of the clear glass or the Nd-containing glass by using the light of the illuminant A as the white exterior light (FIG. 13) which are shown as FIGS. 6 to 9.

In FIGS. 10 to 12, the curve (i) is a spectral reflectance curve of the ZnS:Ag phosphor with a blue colorant the curve (j) is a spectral, reflectance curve of the $Y_2O_2S$:Eu phosphor with a red colorant. A spectral reflectance curve of the three color phosphors (2) as the combination of these blue and red phosphors and the $Gd_2O_2S$:Tb phosphor is the curve (k) in which the reduction of the light component at 470–480 nm is not substantially found. When the ZnS:Cu, Al phosphor is combined with these blue and red phosphors, the spectral reflectance curve is the curve (1) shown in FIG. 11 in which the light component at 470–480 nm is remarkably reduced.

When the ZnS:Cu, Al phosphor having large content of Cu as the activator is combined with these blue and red phosphors, the spectral reflectance curve is the curve (m) shown in FIG. 12 in which the light component at 470–480 nm is further reduced.

FIG. 13 is a CIE chromaticity diagram plotting body colors of the phosphor screens of the three color phosphors as the combinations thereof which are respectively formed on the face plate glass made of the clear glass or the Nd-containing glass by the light of the illuminant A as the white exterior light. The reference (A) designates the chromaticity point of the illuminant A. The reference (H) designates the chromaticity point of the reflected exterior light from the phosphor screen of the three color phosphors (2) as the combination of the $Gd_2O_2S$:Tb phosphor, the ZnS:Ag phosphor with a blue colorant and the $Y_2O_2S$:Eu phosphor with a red colorant formed on the inner surface of the face plate glass (1) made of the clear glass as the chromaticity point of the body color of the phosphor screen. The reference (I) designates the chromaticity point of the reflected exterior light from the phosphor screen of the three color phosphors (2) as the combination of the $Gd_2O_2S$:Tb phosphor, the ZnS:Ag phosphor with a blue colorant and the $Y_2O_2S$:Eu phosphor with a red colorant formed on the inner surface of the face plate glass (1) made of the Nd-containing glass as the chromaticity point of the body color of the phosphor screen. The reference (J) designates the chromaticity point of the reflected exterior light from the phosphor screen of the three color phosphors (2) as the combination of the ZnS:Cu, Al phosphor, the ZnS:Ag phosphor with a blue colorant and the $Y_2O_2S$:Eu phosphor with a red colorant formed on the inner surface of the face plate glass (1) made of the Nd-containing glass as the chromaticity point of the body color of the phosphor screen. The reference (K) designates the chromaticity point of the reflected exterior light from the phosphor screen of the three color phosphors (2) as the combination of the ZnS:Cu, Al phosphor having larger content of Cu as the activator, the ZnS:Ag phosphor with a blue colorant and the $Y_2O_2S$:Eu phosphor with a red colorant formed on the inner surface of the face plate glass (1) made of the Nd-containing glass as the chromaticity point of the body color of the phosphor screen. As it is clearly found from the chromaticity points, the light component at 470–480 nm of the reflected exterior light can be reduced by the combination of the ZnS:Cu, Al phosphor as the green (G) phosphor with the blue colorant-coated blue (B) phosphor and the red colorant-coated red (R) phosphor, whereby the unstable body color caused by the use of the face plate glass (1) made of the Nd-containing glass is remarkably improved. That is, the chromaticity point of the body color is shifted from (I) to (J). When the content of Cu as the activator in the ZnS:Cu, Al phosphor is increased, the stability of the body color of the phosphor screen is further improved by further reducing the light component at 470–480 nm. That is, the chromaticity point is shifted to (K).

The embodiment using the A light source as the white exterior light source has been described. Thus, the same effect is given by reducing the light component at 470–480 nm of the reflected exterior light by the combination of the ZnS:Cu, Al phosphor as the green (G) phosphor in the case of the other white exterior light source such as the white fluorescent lamp and the C light source.

Recently, a black matrix type phosphor screen having light absorption layer between the three color phosphors has been used for improving the contrast of the phosphor screen. The present invention can be applied for such phosphor screen.

In accordance with the present invention, the unstable body color of the phosphor screen caused by the use of the face plate glass made of the Nd-containing glass can be overcome by the combination of the three color phosphors using the ZnS:Cu, Al phosphor as the green (G) phosphor whereby the phosphor screen for the stable body color is given and the contrast and brightness characteristics are improved to provide a cathode ray tube having high quality.

Referring to FIGS. 14 to 19 the other embodiment of the present invention will be illustrated.

In this embodiment, a phosphor of zinc sulfide activated with copper, gold and aluminum (ZnS:Cu, Au, Al) is used as the green (G) phosphor.

Figure 14:
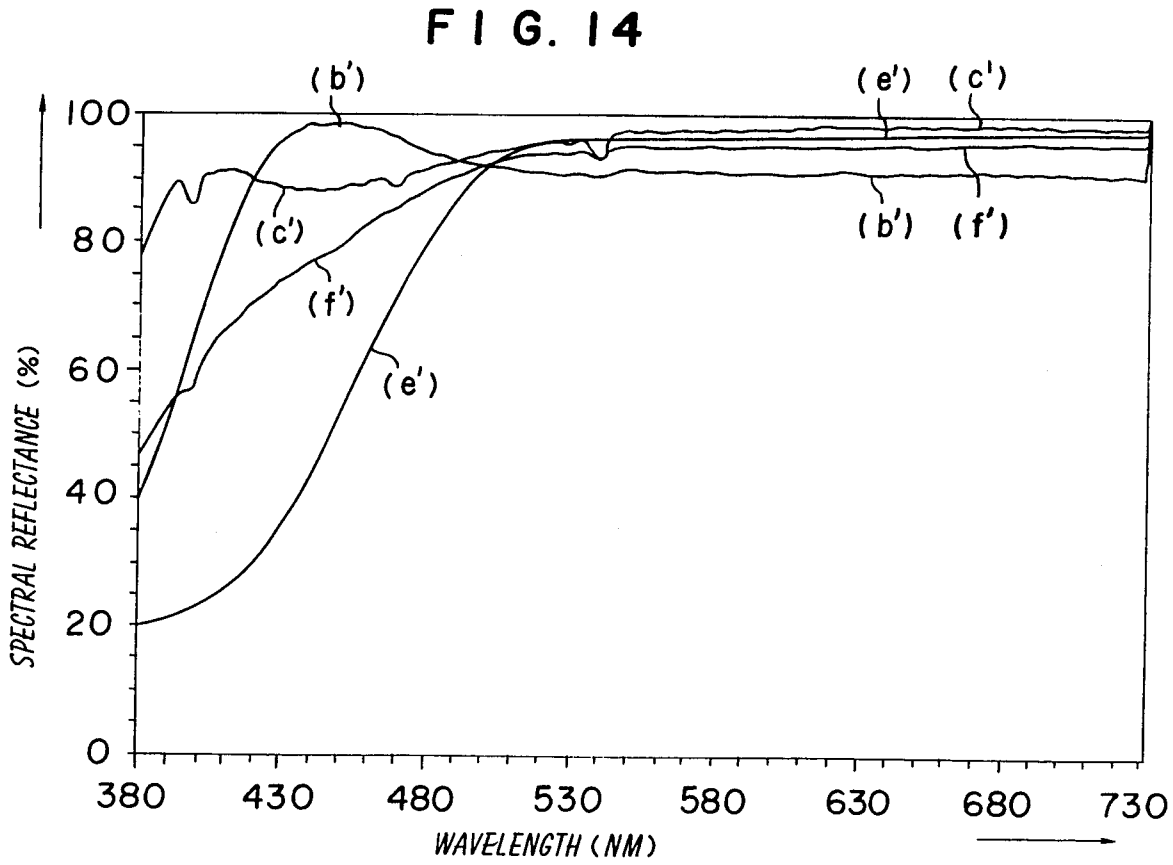
FIGS. 14 and 15 respectively show spectral reflection characteristics of three color phosphors made of various combinations of phosphors.

FIG. 14 shows spectral reflection characteristic of a desired combination of the three color phosphors (2).

The blue (B) phosphor and the red (R) phosphor are the same as the phosphors in FIG. 6 as the ZnS:Ag phosphor and the $Y_2O_2S$:Eu phosphor. Thus, the green (G) phosphor is the ZnS:Cu, Au, Al phophor which has a spectral reflectance curve (e'). Thus, the three color phosphor (2) has the spectral reflectance curve (f') which has the reduction at 470–480 nm. Therefore, the desired body color of the phosphor screen is given by the combination of the three color phosphors and the face plate glass made of a Nd-containing glass. This is resulted by great reduction of the spectral reflectance curve (e') of the ZnS:Cu, Au, Al phosphor used as the green (G) phosphor of the three color phosphors (2) in the shorter wavelength side of the visible wavelength region. The reduction of the spectral reflectance curve in the shorter wavelength side of the visible wavelength region is highly affected by a content of Au as the activator for the phosphor. In the case of the ZnS:Cu, Au, Al phosphor having the spectral reflectance curve (e'), 1 g. of zinc sulfide (ZnS) is activated with about $2\times10^{-4}$ g. of Au as the activator. The reduction of the spectral reflectance curve in the shorter wavelength side of the visible wavelength region increases depending upon an increase of the content of Au as the activator.

Figure 15:
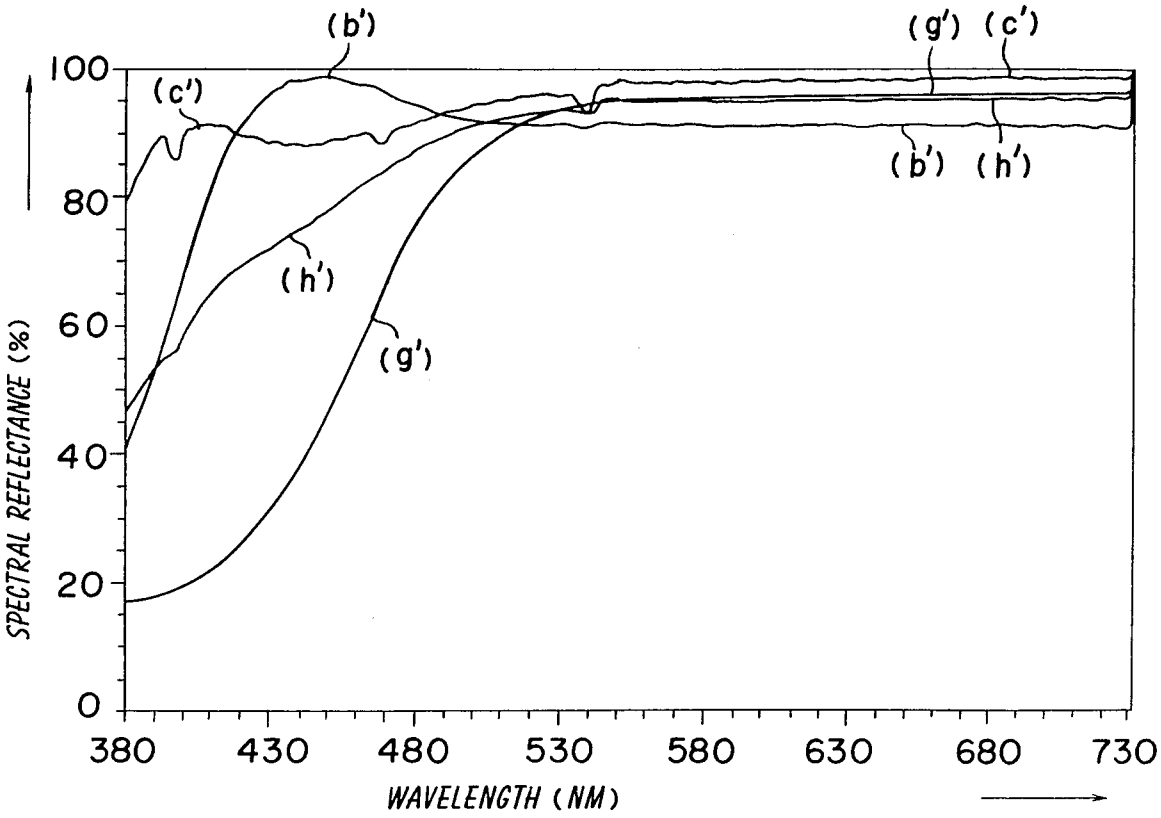

FIG. 15 shows the spectral reflectance curves in the case of the increase of the content of Au as the activator in the Zn S:Cu, Au, Al phosphor used as the green (G) phosphor. The blue (B) phosphor and the red (R) phosphor are respectively the ZnS:Ag phosphor and the $Y_2O_2S$:Eu phosphor shown in FIGS. 6 and 15. In this case, 1 g. of zinc sulfide is activated with about $1.5\times10^{-3}$ g. of Au as the activator. The spectral reflectance curve of the ZnS:Cu, Au, Al phosphor is the curve (g') in which the reduction in the shorter wavelength side of the visible wavelength region is greater than that of the curve (e') in FIG. 14. As result, the spectral reflectance curve of the three color phosphors (2) is the curve (h') in which the reduction in the shorter wavelength of the visible wavelength region is greater than that of the curve (f') in FIG. 14.

Figure 16:
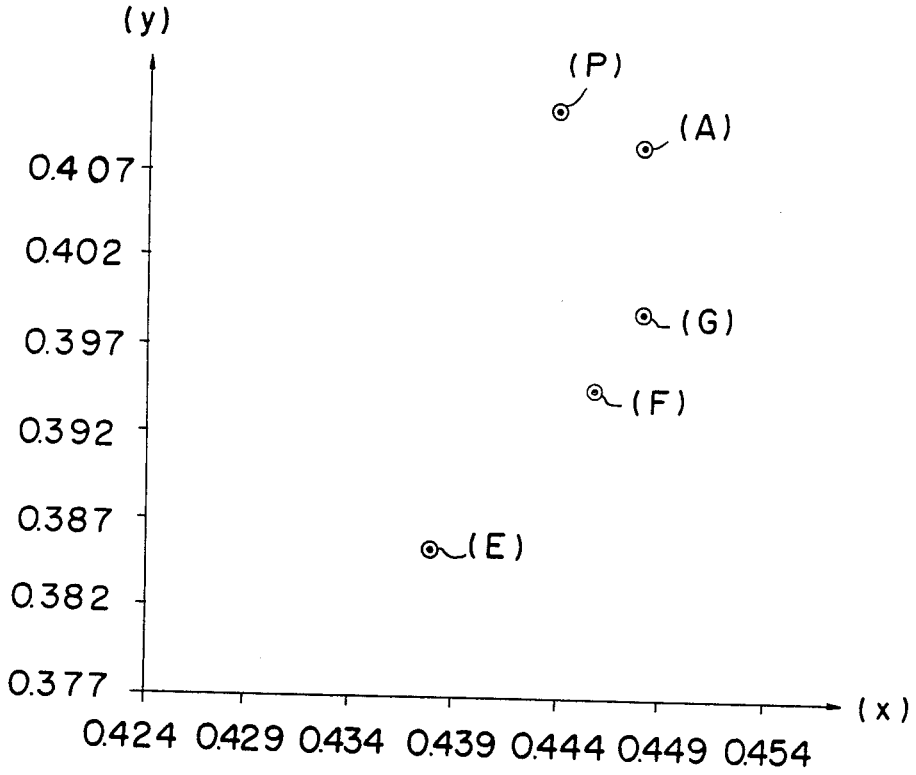
FIG. 16 is a CIE chromaticity diagram plotting chromaticity points of body colors of various phosphor screens.

FIG. 16 is a CIE chromaticity diagram plotting the body color of the phosphor screen by the light of the A light source as the white exterior light in the case of the formation of the three color phosphors (2) in said combination on the face plate glass made of a Nd-containing glass. In FIG. 9, the reference (A) designates a chromaticity point of the A light source; and the reference (P) designates a chromaticity point of the reflected exterior light from the phosphor screen, as the body color of the phosphor screen in the case of the formation of the three color phosphors (2) having substantially flat spectral reflectance as shown in FIG. 6(*d*) as the combination of the $Gd_2O_2S$:Tb green (G) phosphor, the ZnS:Ag blue (B) phosphor and the $Y_2O_2S$:Eu red (R) phosphor on an inner surface of the face plate glass made of the clear glass. The position (P) is slightly different from the position (A) because the spectral transmittance of the clear glass is not completely flat but has slightly difference and the spectral reflectance of the three color phosphors (2) has slightly difference. The reference (E) designates a chromaticity point of the reflected exterior light from the phosphor screen, as the body color of the phosphor screen in the case of the formation of the three color phosphors (2) shown in FIG. 6 as the undesired combination of the $Gd_2O_2S$:Tb green (G) phosphor, the ZnS:Ag blue (B) phosphor and the $Y_2O_2S$:Eu red (R) phosphor on an inner surface of the face plate glass made of the Nd-containing glass. In this case, the body color of the phosphor screen is remarkably shifted from the chromaticity point (A) of the illuminant A as the white exterior light whereby unstable chromaticity is given and the appearance of the phosphor screen is not preferable. The reference (F') designates a chromaticity point of the reflected exterior light from the phosphor screen, as the body color of the phosphor screen in the case of the formation of the three color phosphor shown in FIG. 14 as the desired combination of the ZnS:Cu, Au, Al green (G) phosphor, the ZnS:Ag blue (B) phosphor and the $Y_2O_2S$:Eu red (R) phosphor on an inner surface of the face plate glass made of the Nd-containing glass. As described, the light component at 470–480 nm in the reflected exterior light is reduced and the shift from the chromaticity point (A) of the A light source is remarkably smaller than that of the (E) point.

The reference (G') designate the chromaticity point as the body color of the phosphor screen of the three color phosphors (2) containing the ZnS:Cu, Au, Al phosphor having larger content of Au as the activator. The shift from the chromaticity point (A) of the A light source is less than that of the (F') point.

In view of the contribution for the stability of the body color of the phosphor screen used with the face plate glass made of the Nd-containing glass. The content of Au as the activator in the ZnS:Cu, Au, Al phosphor is preferably $5\times10^{-5}$ g. or more to 1 g. of zinc sulfide as the main component. The stability of the body color of the phosphor screen is further improved by the content of Cu of $4\times10^{-4}$ g. or more to 1 g. of zinc sulfide.

Figure 17:
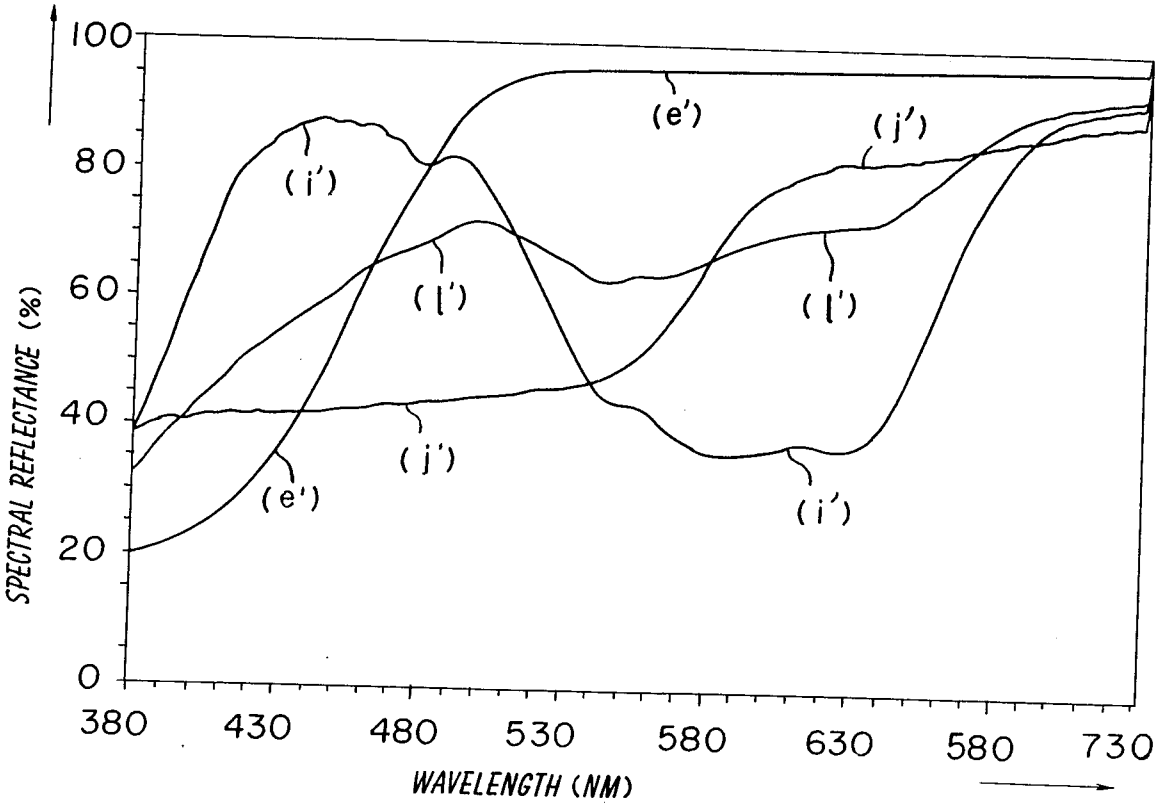
FIGS. 17 and 18 respectively show spectral reflection characteristics of three colors phosphors made of various combinations of phosphors.
Figure 18:
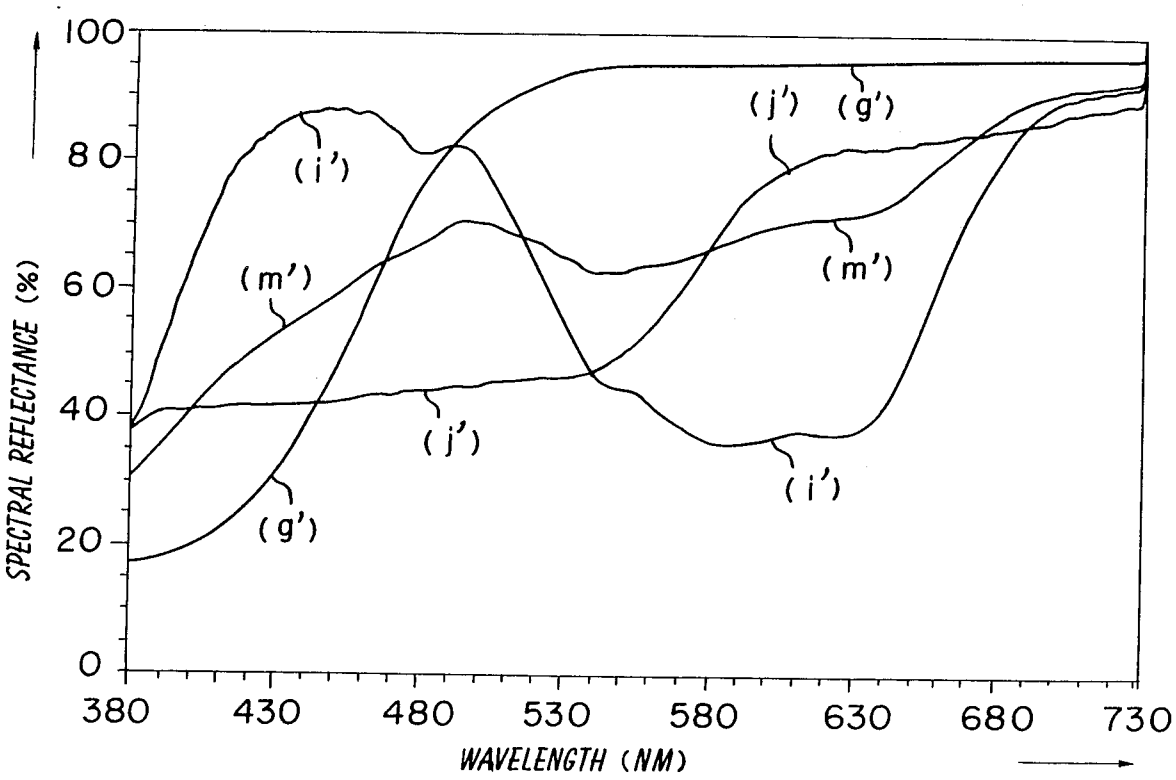
Figure 19:
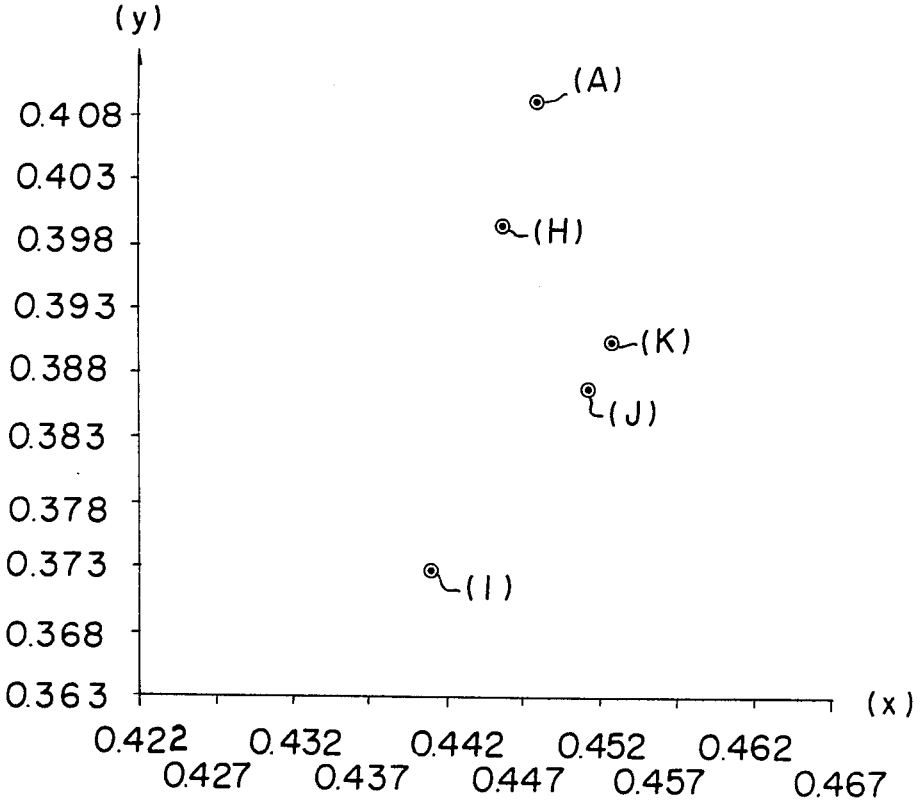
FIG. 19 is a CIE chromaticity diagram plotting chromaticity points of body colors of various phosphor screens.

FIGS. 10, 17, 18 show the spectral reflectance curves of the ZnS:Ag blue phosphor with a blue colorant, as a blue (B) phosphor the $Y_2O_2S$:Eu phosphor with a red colorant as a red (R) phosphor which are recently used to improve the contrast of the phosphor screen and various green (G) phosphor and the three color phosphors as the combinations (FIGS. 10, 17, 18) and a CIE chromaticity diagram FIG. 19 plotting body colors of the phosphor screens of said three color phosphors formed on the inner surface of the face plate glass made of the clear glass or the Nd-containing glass by using the light of the illuminant A as the white exterior light (FIG. 19) which are shown as FIGS. 6, 14, 15, 16.

In FIGS. 10, 17, 18, the curve (i') is a spectral reflectance curve of the ZnS:Ag phosphor with a blue colorant the curve (j') is a spectral, reflectance curve of the $Y_2O_2S$:Eu phosphor with a red colorant. A spectral reflectance curve of the three color phosphors (2) as the combination of these blue and red phosphors and the $Gd_2O_2S$:Tb phosphor is the curve (k') in which the reduction of the light component at 470–480 nm is not substantially found. When the ZnS:Cu, Au, Al phosphor is combined with these blue and red phosphors, the spectral reflectance curve is the curve (1') shown in FIG. 17 in which the light component at 470–480 nm is remarkably reduced.

When the ZnS:Cu, Au, Al phosphor having large content of Au as the activator is combined with these blue and red phosphors, the spectral reflectance curve is the curve (m') shown in FIG. 18 in which the light component at 470–480 nm is further reduced.

FIG. 19 is a CIE chromaticity diagram plotting body colors of the phosphor screens of the three color phosphors as the combinations thereof which are respectively formed on the face plate glass made of the clear glass or the Nd-containing glass by the light of the illuminant A as the white exterior light. The reference (A) designates the chromaticity point of the illuminant A. The reference (H) designates the chromaticity point of the reflected exterior light from the phosphor screen of the three color phosphors (2) as the combination of the $Gd_2O_2S$:Tb phosphor, the ZnS:Ag phosphor with a blue colorant and the $Y_2O_2S$:Eu phosphor with a red colorant formed on the inner surface of the face plate glass (1) made of the clear glass as the chromaticity point of the body color of the phosphor screen. The reference (I) designates the chromaticity point of the reflected exterior light from the phosphor screen of the three color phosphors (2) as the combination of the $Gd_2O_2S$:Tb phosphor, the ZnS:Ag phosphor with a blue colorant and the $Y_2O_2S$:Eu phosphor with a red colorant formed on the inner surface of the face plate glass (1) made of the Nd-containing glass as the chromaticity point of the body color of the phosphor screen. The reference (J') designates the chromaticity point of the reflected exterior light from the phosphor screen of the three color phosphors (2) as the combination of the ZnS:Cu, Au, Al phosphor, the ZnS:Ag phosphor with a blue colorant and the $Y_2O_2S$:Eu phosphor with a red colorant formed on the inner surface of the face plate glass (1) made of the Nd-containing glass as the chromaticity point of the body color of the phosphor screen. The reference (K') designates the chromaticity point of the reflected exterior light from the phosphor screen of the three color phosphors (2) as the combination of the ZnS:Cu, Au. Al phosphor having larger content of Au as the activator, the ZnS:Ag phosphor with a blue colorant and the $Y_2O_2S$:Eu phosphor with a red colorant formed on the inner surface of the face plate glass (1) made of the Nd-containing glass as the chromaticity point of the body color of the phosphor screen. As it is clearly found-from the chromaticity points, the light component at 470–480 nm of the reflected exterior light can be reduced by the combination of the ZnS:Cu, Au, Al phosphor as the green (G) phosphor with the blue colorant-coated blue (B) phosphor and the red colorant-coated red (R) phosphor, whereby the unstable body color caused by the use of the face plate glass (1) made of the Nd-containing glass is remarkably improved. That is, the chromaticity point of the body color is shifted from (I) to (J'). When the content of Au as the activator in the ZnS:Cu, Au, Al phosphor is increased, the stability of the body color of the phosphor screen is further improved by further reducing the light component at 470–480 nm. That is, the chromaticity point is shifted to (K').

The embodiment using the A light source as the white exterior light source has been described. Thus, the same effect is given by reducing the light component at 470–480 nm of the reflected exterior light by the combination of the ZnS:Cu, Au, Al phosphor as the green (G) phosphor in the case of the other white exterior light source such as the white fluorescent lamp and illuminant C.

Recently, a black matrix type phosphor screen having light absorption layer between the three color phosphors has been used for improving the contrast of the phosphor screen. The present invention can be applied for such phosphor screen.

In accordance with the present invention, the unstable body color of the phosphor screen caused by the use of the face plate glass made of the Nd-containing glass can be overcome by the combination of the three color phosphors using the ZnS:Cu, Au, Al phosphor as the green (G) phosphor whereby the phosphor screen for the stable body color is given and the contrast and brightness characteristics are improved to provide a cathode ray tube having high quality.

The face plate glass can be a combination of a main face plate glass made of a clear glass and a front plate glass made of the Nd-containing glass.

We claim:

1. A cathode ray tube having a face plate glass which contains neodymium oxide ($Nd_2O_3$) and exhibits a sharp main absorption band having a peak at about 580 nm and a sub-absorption at about 530 nm and on the inner surface of which a phosphor screen having blue, green and red phosphors is formed, wherein said blue phosphor is a phosphor of zinc sulfide activated with Ag(ZnS:Ag), said red phosphor is a phosphor of yttrium oxysulfide activated with Eu($Y_2O_2S$:Eu), and said green phosphor is a phosphor of zinc sulfide activated with copper and aluminum (ZnS:Cu, Al) to reduce the spectral reflectance of said phosphor screen at the wavelength band of 470–480 nm so that the chromaticity point of a reflected exterior light reflected from said phosphor screen is prevented from displacement with respect to the chromaticity point of an exterior light due to the influence of said main and sub-absorption bands.

2. The cathode ray tube according to claim 1, wherein a content of copper (Cu) as an activator is $3\times10^{-4}$ g, or more to 1 g. of zinc-sulfide (ZnS) as the main component.

3. The cathode ray tube according to claim 1, wherein each of said blue and red phosphors is a phosphor with a colorant.

4. A cathode ray tube having a face plate glass which contains neodymium oxide ($Nd_2O_3$) and exhibits a sharp main absorption band having a peak at about 580 nm and a sub-absorption band at about 530 nm and on the inner surface of which a phosphor screen having blue, green and red phosphors is formed, wherein said blue phosphor is a phosphor of zinc sulfide activated with Ag(ZnS:Ag), said red phosphor is a phosphor of yttrium oxysulfide activated with Eu($Y_2O_2S$:Eu) and said green phosphor is a phosphor of zinc sulfide activated with copper, gold and aluminum (ZnS:Cu, Au, Al) to reduce the spectral reflectance of said phosphor screen at the wavelength band of 470–480 nm so that the chromaticity point of a reflected exterior light reflected from said phosphor screen is prevented from displacement with respect to the chromaticity point of an exterior light due to the influence of said main and sub-absorption bands.

5. The cathode ray tube according to claim 4, wherein a content of gold (Au) as an activator is $4\times10^{\times4}$ g. or more to 1 g. of zinc-sulfide (ZnS) as the main component.

6. The cathode ray tube according to claim 4, wherein each of said blue and red phosphors is a phosphor with a colorant.

* * * * *